US005729787A

United States Patent [19]

Resch, III

[11] Patent Number: 5,729,787

[45] Date of Patent: Mar. 17, 1998

[54] TONER CONCENTRATION MONITOR AND METHOD

[75] Inventor: William A. Resch, III, Pittsford, N.Y.

[73] Assignee: Eastman Kodak Company, Rochester, N.Y.

[21] Appl. No.: 685,261

[22] Filed: Jul. 23, 1996

[51] Int. Cl.[6] ..... G03G 15/10

[52] U.S. Cl. ..... 399/62; 324/204; 399/30

[58] Field of Search ..... 399/58, 61, 62, 399/63, 27, 29, 30; 324/204, 234, 236, 226, 239, 445–449; 73/53.01, 61.71, 865.5

[56] References Cited

U.S. PATENT DOCUMENTS

| | | | |
|---|---|---|---|
| 3,789,296 | 1/1974 | Caruso, Jr. et al. . | |
| 4,592,645 | 6/1986 | Kanai et al. . | |
| 4,660,505 | 4/1987 | Goto et al. . | |
| 4,679,426 | 7/1987 | Fuller et al. | 73/53.01 |
| 4,706,032 | 11/1987 | Allen et al. | 399/62 |
| 4,765,179 | 8/1988 | Fuller et al. | 73/53.01 |
| 4,786,857 | 11/1988 | Mohr et al. . | |
| 4,918,375 | 4/1990 | Malicki et al. . | |
| 4,947,788 | 8/1990 | Hill et al. | 399/119 |
| 4,949,399 | 8/1990 | Williams et al. | 399/119 |
| 4,956,668 | 9/1990 | Arnold et al. | 399/59 |
| 5,111,247 | 5/1992 | Nichols | 399/63 |
| 5,173,749 | 12/1992 | Tell et al. . | |
| 5,249,463 | 10/1993 | Wilson et al. . | |
| 5,307,124 | 4/1994 | Stelter | 399/62 |
| 5,384,629 | 1/1995 | Watanabe et al. | 399/120 |

*Primary Examiner*—Matthew S. Smith
*Attorney, Agent, or Firm*—Norman Rushefsky

[57] ABSTRACT

A toner monitor particularly suited for monitoring toner concentration in a two-component development mixture includes an electrically conductive probe mounted in a wall of a development apparatus but the probe does not extend substantially into the developer mixture. A square wave generator or other multifrequency signal source generates a first signal so that electromagnetic energy is carried along the probe and into the mixture. A second signal is generated in response to an impedance mismatch between the mixture and the probe. In response to the second signal, a third signal is generated relating to adjustment of composition content of the development mixture.

20 Claims, 3 Drawing Sheets

TONER CONCENTRATION MONITOR AND METHOD

BACKGROUND OF THE INVENTION

1. Field of the Invention

This invention relates to electrostatography and more particularly to an apparatus and method for monitoring a concentration of toner in a two-component type developer.

2. Description Relative to the Prior Art

Developers used for electrophotographic copying apparatus, facsimile apparatus, printers, etc. include a two-component type developer in the form of a mixture of a magnetic carrier and a color toner. When an electrostatic latent image is developed with such a developer, the color toner is consumed by attaching to the latent image. However, the magnetic carrier in the developer does not decrease, resulting in a decrease in the ratio of the color toner to the magnetic carrier in the developer (which ratio will be referred to hereinafter as toner concentration).

For attainment of good-quality development, it is necessary to maintain the toner concentration of the developer within a predetermined range, and, for this purpose, there is a toner concentration control apparatus which detects the toner concentration of the developer to replenish the color toner in the developer.

There are two main methods of monitoring toner concentration in multicomponent systems. In one method, an indirect measurement method, toner concentration is determined through measurement of toner laid down on the photoconductor. More direct methods involve measurements made at the development stations. Thus, in one known approach, infra-red is input through a window in the development sump and the reflections back are measured and used to infer toner concentration. In still another approach, a planar electric coil has been disposed at a suitable position in the developer container surrounded by a stream of developer. Changes in the coil inductance increases with the decrease of the toner concentration of the developer. In yet another approach, magnetic detectors are provided at a position in a container containing a developer including a magnetic carrier and a color toner so that a coupling coefficient of a magnetic circuit changes with concentration of the toner.

A problem associated with systems of the prior art is that they attempt to determine toner concentration of a two component system with a single measurement. Two independent measurements are required for a more accurate monitoring result under various possible operating conditions. A further problem is that some of these monitors require the monitor have a probe that is within the development housing.

The invention herein proposes an inexpensive means for accurately determining toner concentration using a single probe. The method and apparatus described herein provides for simultaneous measurements of each component or of one component and the mixture and thus provides for a more accurate computation of the ratio of the components.

SUMMARY OF THE INVENTION

In accordance with the above and other objects of the invention which will be apparent from the detailed description provided below there is provided a toner monitor, comprising an electrically conductive probe mounted in a wall of a development apparatus, the apparatus including plural components forming a multicomponent development mixture; means for generating a first signal so that electromagnetic energy is carded along said probe and into said mixture; means for generating a second signal that is in response to an impedance mismatch of said mixture and said probe; and means responsive to said second signal for generating a third signal relative to adjustment of composition content of the development mixture.

In accordance with another aspect of the invention, there is provided an electrostatographic reproduction apparatus comprising an imaging member for supporting an electrostatographic image; development means including a mixture of toner and carder particles for developing the imaging member, the development means including wall means for defining a sump for the mixture; toner monitor means for monitoring concentration of toner in the mixture, the toner monitor means including an electrically conductive probe mounted in the wall means of the development means; means for generating a first signal so that electromagnetic energy is carded along said probe and into said mixture; means for generating a second signal that is in response to an impedance mismatch between said mixture and said probe; and means responsive to said second signal for generating a third signal relative to adjustment of composition content of the development mixture.

In accordance with still another aspect of the invention, there is provided a method of monitoring a mixture of dry toner components in a development mixture the method comprising generating a first signal so that electromagnetic energy is carried along a conductive probe and into said mixture, generating second signals that are in response to an impedance mismatch of said mixture and said probe; and in response to said second signals generating a third signal relative to adjustment of composition content of the development mixture.

BRIEF DESCRIPTION OF THE DRAWINGS

In the detailed description of the invention presented below, reference is made to the drawings, in which.

DETAILED DESCRIPTION OF THE PREFERRED

EMBODIMENTS OF THE INVENTION

Because electrostatographic reproduction machines are well known, the present description will be directed in particular to elements thereof which form part of or cooperate more directly with the present invention. Elements thereof not specifically shown or described herein are assumed selectable from those known in the prior art.

Figure 1:
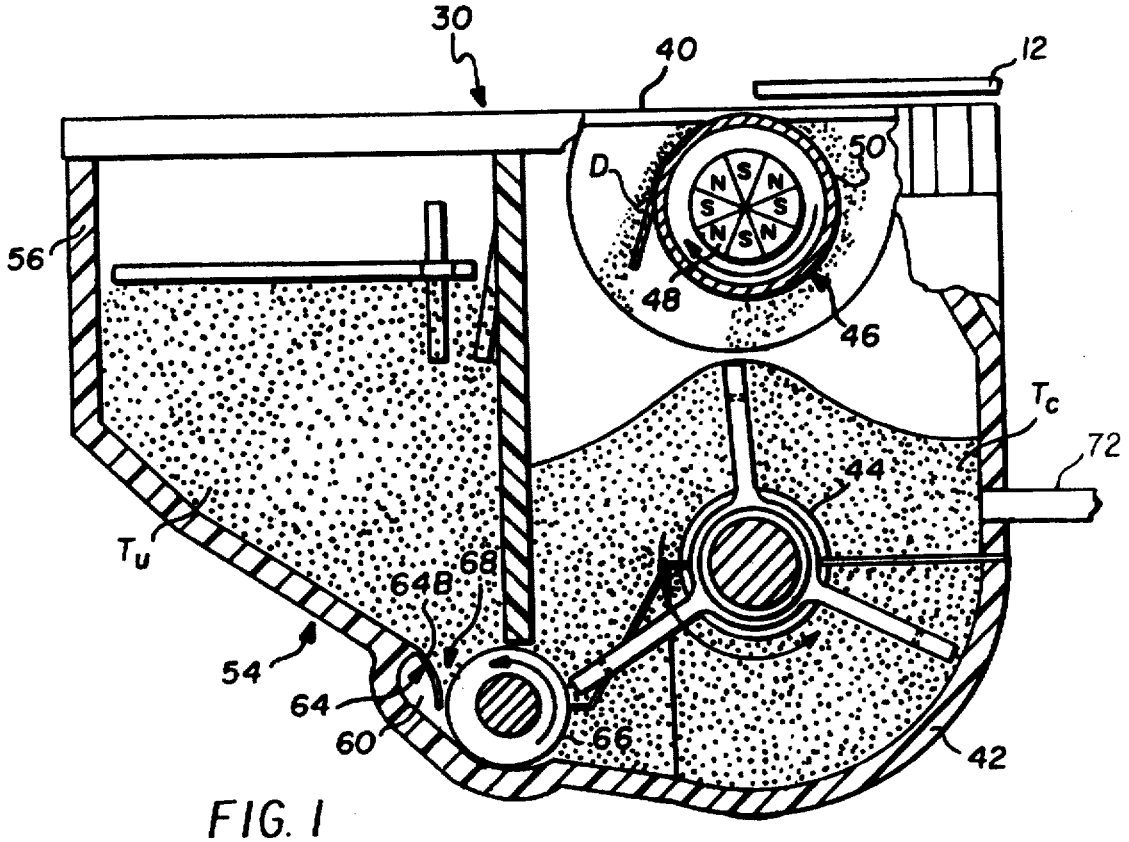
FIG. 1 is an end view partly in section, of an exemplary development apparatus and a portion of a first embodiment of the improved toner monitoring apparatus of the invention.
Figure 2:
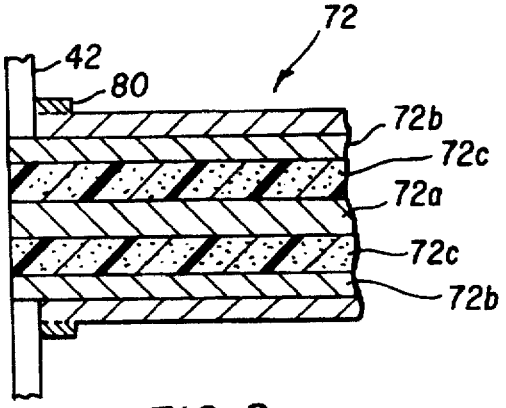
FIG. 2 is a close-up view of the portion of the toner monitoring apparatus illustrated in FIG. 1.

Referring to FIGS. 1 and 2, an electrostatographic reproduction apparatus (not shown) such as a copier or printer has a dielectric image forming and image transfer member such as a flexible photoconductive web 12 or drum. A latent electrostatic image is formed on the web 12 by suitable means, not shown, as is well known in the prior art.

The latent electrostatic image on the surface of the web 12 is developed with toners at the development apparatus shown generally as 30 (to be described in detail below) in order to form a toner image. The toner image may remain with the surface 12 or be transferred to a receiver sheet as is also well known. In order to reuse the belt mechanical and/or electrical cleaning of belt 12 is effected at a cleaning station in preparation for the formation and transfer of another toner image. As is well known in the art, the operation and sequencing of the stations and components of the reproduction apparatus 10 are controlled by a logic and control unit (LCU).

The development apparatus 30 includes a housing 40 with a sump portion 42 for holding a multiple-component developer material D that contains charged carrier particles, and oppositely charged toner particles at a desired toner particle concentration level. A rotatable, primary developer material charging device 44 is located within the sump portion 42 for moving, mixing and thereby triboelectrically charging the toner particles with the carrier particles of the developer material in the sump portion 42. As is well known, such moving and mixing of the developer material must be continued for a characteristically necessary time interval, (a time to depend on the charging characteristics of the components of the developer material), in order to triboelectrically charge the toner particles to a desired charge level that is suitable for high quality image development.

The development apparatus 30 also includes a development roller 46 for transporting the triboelectrically charged developer material including the toner particles from the sump portion 42 into an image development area and relationship, with electrostatic latent images on the surface of the image beating member 12. In the image development area the charged toner particles are attracted from the developer material admixture on the roller 46 onto the surface of the member 12 thereby developing the latent images on the member 12. Following such development, the developer material on the surface of the roller 46 is partially depleted of toner particles, and is returned to the sump portion 42 for re-mixing and re-charging. As shown, the development roller 46 may for example include a rotatable magnetic core 48 of circumferentially arranged and alternating pole magnets, and a non-magnetic shell 50 which supports the developer material admixture D as it is being transported into the image development area.

Image development using attracted toner particles as above ordinarily depletes toner particles contained in the developer material that is repeatedly being returned from the image development area to the sump portion 42. As a result, the quantity and concentration of toner particles left in the developer material D in the development apparatus eventually will drop to an undesirable level, at and below which, the quality of image development is unacceptable. In order to avoid such an undesirable drop in toner concentration, the concentration of toner particles in the development apparatus is monitored.

For monitoring the concentration of toner particles in the developer material D, the development apparatus 30 includes a toner monitor 70. Typically, the toner monitor 70 is connected and controlled commonly with a toner particle replenishment assembly, such as the toner particle replenishment assembly of the present invention shown generally as 54. Such control is carried out through the logic and control unit which, for example, may be in the form of a microprocessor (μP) in order to timely add uncharged toner particles to the sump portion 42 so as to maintain the desired toner concentration of the developer material D. Such addition of uncharged toner particles however, immediately results in a lowering of the average charge level of toner particles in the sump 42. The newly added toner particles $T_u$ must therefore be moved and mixed for a necessary characteristic time interval in order to raise the charge level on them to the desired charge level.

A replenishment assembly 54 includes a hopper portion 56 for holding a supply of fresh or new uncharged toner particles, a metering means 60 for metering the toner particles $T_u$ from the hopper portion 56 through to the sump portion 42 for triboelectric charging. The replenishment assembly 54 includes electrical charging means (not shown) for controllably and electrically precharging the new, uncharged toner particles $T_u$ which are being metered into the sump portion 42. Such electrical pre-charging of the toner particles $T_u$ can be controllably achieved to a desired precharge level such as would substantially prevent uncharged or poorly charged toner particles from being transported from the sump portion, during high speed, high density image development periods, to the image development area. Such electrical precharging of the uncharged toner particles also reduces the time interval necessary (in the sump portion 42) for moving and mixing the toner particles in the replenished developer material in order to raise the level of charge on all toner particles in such developer material to the desired level.

Figure 3:
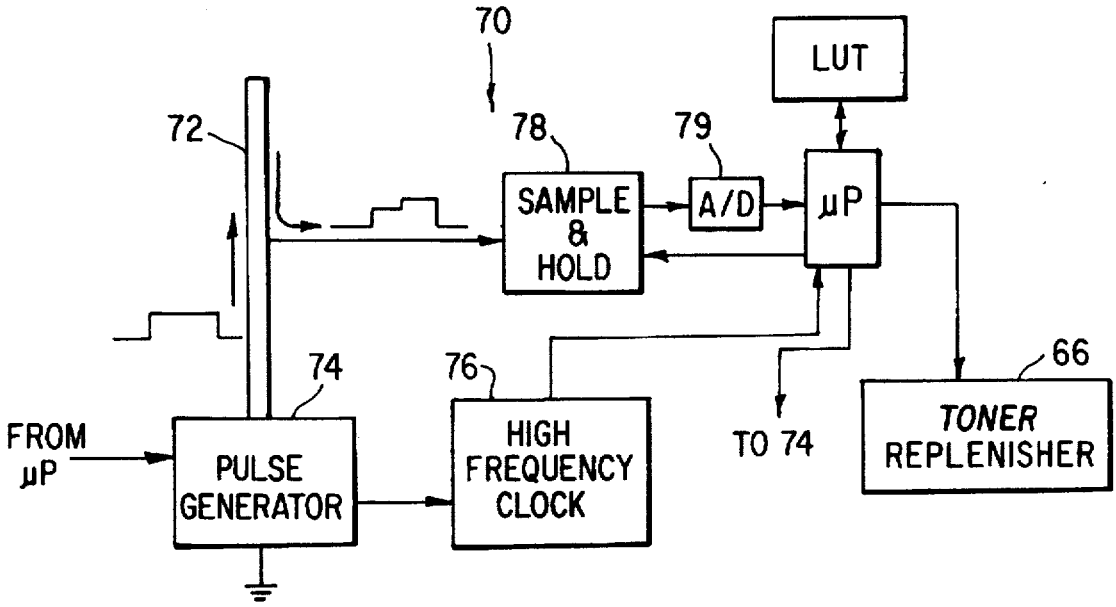
FIG. 3 is a block diagram schematic of the first embodiment of the toner monitoring apparatus of the invention.
Figure 4:
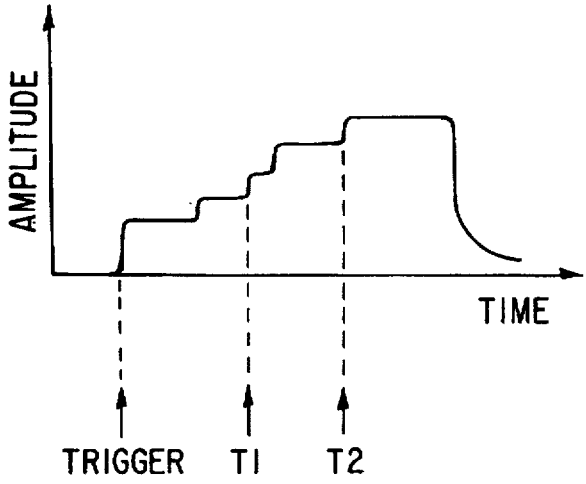
FIG. 4 is an illustration of a timing diagram illustrating sampling times during use of the apparatus of the invention and FIG. 5 is a flowchart illustrating steps in the toner monitoring method of the invention.
Figure 5:
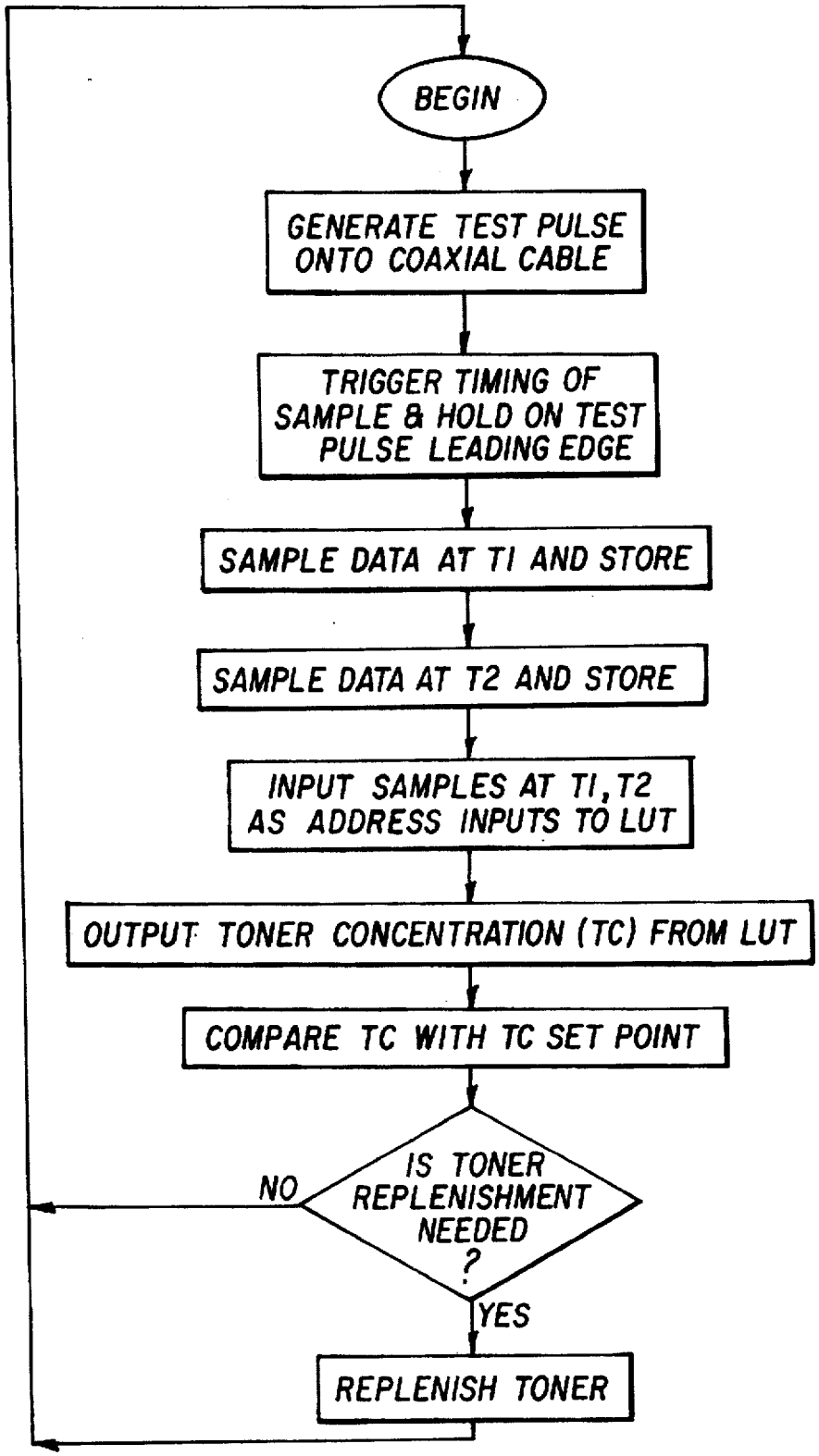

With reference to FIGS. 2–4, the improved toner monitor of the invention uses time domain reflectometry to provide a measure of the ratio of the two principal components of the developer material. A waveguide or probe 72, such as a coaxial cable is attached to the development apparatus at the sump portion 42. The wave guide 72 ends at the inside end of the housing wall of the sump portion 42 and preferably does not extend substantially into the toning medium wherein it is likely to interfere with mixing of the developer material components. In accordance with the invention, electromagnetic energy flows in a waveguide of uniform impedance without disturbance. At any discontinuity where the impedance changes, some energy, attenuated in magnitude and shifted in phase, is reflected. The open-ended waveguide of the invention constitutes such a discontinuity and is preferably in contact with the development material with which the incident energy interacts. In accordance with the invention the reflected energy is modified in magnitude and phase by the interaction of the incident energy upon the material at the discontinuity. Since each material in the development mixture is known to be responsive to a characteristic frequency, the two frequencies can be used to simultaneously measure each of the two components of the mix. Similarly, if one component of the mix is substantially more responsive to some frequency than the other component but both are equally responsive to some second frequency the relative amounts of each component can also be deduced. In the case of development materials exhibiting a complex response across a range of frequencies, the use of a square wave impulse of infinite frequency content and shown in FIGS. 3 and 4 may be more advantageous. While analysis of the returned signal could be done transforming the waveform into its many harmonically-related frequency components by well-known techniques (i.e. Fourier Analysis) and then examining two selected frequencies, signal amplitude measurement at two different times would also constitute a useful measurement for materials responsive to two different bands of frequencies. In each case the amount of signal attenuation measures the amount of material sensible by the energy at the discontinuity and the ratio of the attenuations would measure the ratio of the materials. In particular, non-uniform filling or packing of the measurement volume at the waveguide exit by the material of interest does not introduce fundamental error into the ratio measurement as such non-uniformity does in the prior art toner monitors.

The toner monitor 70 includes, in addition to the coaxial cable probe 72, a pulse generator 74 which under control of a microprocessor (μP) generates a square wave pulse along the inner conductor 72*a* of the probe.

Simultaneously, with generation of the square wave pulse, a high frequency clock 76 commences generating clock pulses that are counted by the μP to determine timing periods T1 and T2. The high frequency clock may form a part of the microprocessor. The energy of the square wave pulse is transmitted along the conductor 72*a* and where the conductor is terminated the energy enters the mixture in the development sump and is reflected back. The reflected energy modulates the square wave signal. An example of a modulated signal is illustrated in FIG. 4. As may be seen in FIG. 4 the amplitude of the signal changes in the time domain. The μP is programmed to enable a sample and hold circuit 78, which is connected or otherwise coupled to the inner conductor of the probe, to sample the amplitude of the modulated signals at the times T1 and T2. These times are determined through experiment to relate to the characteristic response times for each of the component materials of the developer. The respective amplitudes at these times will vary in accordance with respective concentration amounts of the components of the developer. A lookup table (LUT) may be created based on experimental observations relating amplitudes with relative concentrations or amounts from which replenishment signals may be generated by the μP to the toner replenisher 66. The detected amplitudes at times T1 and T2 are communicated to the μP through, for example, an analog to digital converter 79. The LUT may be arranged so that inputs of the amplitudes at T1 and T2 are used to generate the toner replenishment signal directly.

As illustrated in FIG. 2, the coaxial cable is attached to the wall of the sump portion 42 by a connector 80 which may be of any well known means for providing such a connection. The cable in addition to including a central conductor 72*a* includes a grounded shield 72*b* which surrounds the central conductor and is electrically isolated therefrom by insulation 72*c*.

In lieu of employing a square wave or other generator of signals of multiple frequencies, the invention also contemplates that the pulse generator may emit sine waves of only two discrete frequencies. These may be emitted at different times so that the amplitudes of the reflected waves of each may be measured separately and used to determine the concentration of components of the developer and/or provide replenishment accordingly. The frequencies are selected based on experiment to determine which component is more responsive to which frequency.

The invention has been described in detail with particular reference to preferred embodiments thereof and illustrative examples, but it will be understood that variations and modifications can be effected within the spirit and scope of the invention.

I claim:

1. A toner monitor, comprising:

an electrically conductive probe mounted in a wall of a development apparatus, the apparatus including plural components forming a multicomponent development mixture, the probe not extending substantially into the development mixture;

means for generating a first signal so that electromagnetic energy is carried along said probed and modified by an impedance mismatch of said probe and the mixture to form a modified signal said probe;

means for sampling the modified signal on said probe and generating a second signal representing a sample of the modified sample on said probe; and means responsive to said second signal for generating a third signal relative to adjustment of composition content of the development mixture.

2. The monitor of claim 1 wherein said means for generating a first signal is a square wave generator, said means for generating a second signal includes timing means for sampling the square wave signal as modulated by reflected energy resulting from an impedance mismatch between the probe and the mixture.

3. The toner monitor of claim 1 wherein the means for generating the first signal comprises a signal generator for generating signals of two discrete frequencies.

4. The monitor of claim 1 wherein said means for generating a first signal generates a signal containing plural frequency components.

5. An electrostatographic reproduction apparatus comprising:

an imaging member for supporting an electrostatographic image;

development means including a mixture of toner and carrier particles for developing the imaging member, the development means including wall means for defining a sump for the mixture;

toner monitor means for monitoring concentration of toner in the mixture, the toner monitor means including:

an electrically conductive probe mounted in the wall means of the development means, the probe not extending substantially into the development mixture:

means for generating a first signal so that electromagnetic energy is carried along said probe and modified by an impedance mismatch of said probe and the mixture to form a modified signal on said probe;

means for sampling the modified signal on said probe and generating a second signal representing a sample of the modified signal on said probe; and means responsive to said second signal for generating a third signal relative to adjustment of composition content of the development mixture.

6. The apparatus of claim 5 wherein said means for generating a first signal is a square wave generator, said means for generating a second signal includes timing means for sampling the square wave signal as modulated by reflected energy resulting from an impedance mismatch between the probe and the mixture.

7. The apparatus of claim 5 wherein the means for generating the first signal comprises a signal generator for generating signals of two discrete frequencies.

8. The apparatus of claim 5 wherein said means for generating a first signal generates a signal containing plural frequency components.

9. A method of monitoring a mixture of dry toner components in a development mixture, the method comprising:

generating a first signal so that electromagnetic energy is carried along a conductive probe and into said mixture, the probe not extending substantially into said mixture and the first signal being modified by an impedance mismatch of the probe and the mixture to form a modified signal or the probe, sensing the modified signal of the probe and generating second signals that are in response to said sensing; and in response to said second signals generating a third signal relative to adjustment of composition content of the development mixture.

10. The method of claim 9 wherein the first signal is a square wave.

11. The method of claim 10 wherein the second signals are timed samples of the modified signal.

12. The method of claim 9 wherein the second signals are timed samples of the modified signal.

13. The method of claim 9 wherein the first signal comprises plural frequency components and the second signals comprise samples of amplitude of the modified signal.

14. A toner monitor, comprising:

an electrically conductive probe mounted in a wail of a development apparatus, the apparatus including plural components forming a multicomponent development mixture and the probe not extending substantially into the development mixture;

a signal generator coupled to the probe and generating a first electrical signal along said probe, the first electrical signal being modified on the probe in response to an impedance mismatch between the probe and the mixture to form a modified signal on the probe;

a sensor operative to sense the modified signal on the probe and generating a second signal in response to sensing of the modified signal; and a controller responsive to said second signal for generating a third signal relative to adjustment of composition content of the development mixture.

15. The monitor of claim 14 wherein said signal generator is a square wave generator, and said sensor includes a sampling device for sampling the square wave signal as modulated by reflected energy resulting from an impedance mismatch between the probe and the mixture.

16. The monitor of claim 14 wherein the signal generator generates signals of two discrete frequencies.

17. The monitor of claim 14 wherein said signal generator generates a first signal containing plural frequency components.

18. An electrostatographic reproduction apparatus comprising:

an imaging member for supporting an electrostatographic image;

development means including a mixture of toner and carrier particles for developing the imaging member, the development means including wall means for defining a sump for the mixture;

toner monitor means for monitoring concentration of toner in the mixture, the toner monitor means including:

an electrically conductive probe mounted in the wall means of the development means, the probe not extending substantially into the development mixture, a signal generator coupled to the probe and generating a first electrical signal along the probe, the first electrical signal being modified on the probe in response to an impedance mismatch between the probe and the mixture to form a modified signal on the probe;

a sensor operative to sense the modified signal on the probe and generating a second signal in response to sensing of the modified signal; and a controller responsive to said second signal for generating a third signal relative to adjustment of composition content of the development mixture.

19. The apparatus of claim 18 wherein said signal generator is a square wave generator, and said sensor includes a sampling device for sampling the square wave signal as modulated by reflected energy resulting from an impedance mismatch between the probe and the mixture.

20. The apparatus of claim 18 wherein the signal generator generates signals of two discrete frequencies.

* * * * *